US011781281B2

(12) United States Patent
Conner et al.

(10) Patent No.: US 11,781,281 B2
(45) **Date of Patent: *Oct. 10, 2023**

(54) FORMS AND SUBSURFACE STRUCTURAL ELEMENTS THAT REDIRECT SOIL FORCES

(71) Applicant: V-Forms, LLC, Austin, TX (US)

(72) Inventors: James C. Conner, Austin, TX (US); DeWayne Krawl, Austin, TX (US); Omar Besim Hakim, Austin, TX (US)

(73) Assignee: V-Forms, LLC, Cedar Park, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/473,652

(22) Filed: Sep. 13, 2021

(65) Prior Publication Data

US 2022/0106761 A1 Apr. 7, 2022

Related U.S. Application Data

(63) Continuation of application No. 16/723,779, filed on Dec. 20, 2019, now Pat. No. 11,118,322, which is a continuation of application No. 16/171,300, filed on Oct. 25, 2018, now Pat. No. 10,519,618, which is a continuation of application No. 15/400,837, filed on Jan. 6, 2017, now Pat. No. 10,113,289.

(60) Provisional application No. 62/276,018, filed on Jan. 7, 2016.

(51) Int. Cl.

| | |
|---|---|
| ***E02D 27/08*** | (2006.01) |
| ***E02D 27/02*** | (2006.01) |
| ***E02D 27/12*** | (2006.01) |
| ***E04G 13/00*** | (2006.01) |

(52) U.S. Cl.

CPC ..... *E02D 27/08* (2013.01); *E02D 27/02* (2013.01); *E02D 27/12* (2013.01); *E04G 13/00* (2013.01); *E02D 2200/165* (2013.01); *E02D 2200/1678* (2013.01); *E02D 2250/0007* (2013.01); *E02D 2250/0023* (2013.01); *E02D 2300/002* (2013.01)

(58) Field of Classification Search

CPC combination set(s) only.

See application file for complete search history.

(56) References Cited

U.S. PATENT DOCUMENTS

| | | | |
|---|---|---|---|
| 3,090,204 | A | 5/1963 | Upson |
| 4,738,061 | A | 4/1988 | Herndon |
| 4,783,935 | A | 11/1988 | Creager |
| 4,824,262 | A | 4/1989 | Kamigaito et al. |
| 5,039,256 | A | 8/1991 | Gagliano |

(Continued)

FOREIGN PATENT DOCUMENTS

| | | |
|---|---|---|
| EP | 0952258 | 10/2002 |

OTHER PUBLICATIONS

U.S. Appl. No. 16/171,300, filed Oct. 25, 2018, James C. Conner et al.

*Primary Examiner* — Kyle Armstrong

(74) *Attorney, Agent, or Firm* — Robert C. Kowert; Kowert, Hood, Munyon, Rankin & Goetzel, P.C.

(57) ABSTRACT

Embodiments described herein relate to construction of subsurface structural elements that are configured to redirect soil forces. For instance, a form may be used to construct a subsurface structural element such that the subsurface structural element redirects soil forces to vertically displace a foundation rather than have the soil forces crack or otherwise damage the foundation.

20 Claims, 10 Drawing Sheets

(56) References Cited

U.S. PATENT DOCUMENTS

| | | | | |
|---|---|---|---|---|
| 5,234,290 | A | 8/1993 | Collins | |
| 5,951,207 | A | 9/1999 | Chen | |
| 10,113,289 | B2 * | 10/2018 | Conner | E04G 13/00 |
| 10,519,618 | B2 * | 12/2019 | Conner | E04G 13/00 |
| 11,118,322 | B2 * | 9/2021 | Conner | E02D 27/08 |
| 2001/0010410 | A1 | 8/2001 | Meehan et al. | |
| 2011/0002744 | A1 * | 1/2011 | Tadros | E02D 5/58 405/232 |
| 2013/0313740 | A1 | 11/2013 | Gilpin et al. | |
| 2014/0186112 | A1 | 7/2014 | Hassan | |

* cited by examiner

FORMS AND SUBSURFACE STRUCTURAL ELEMENTS THAT REDIRECT SOIL FORCES

PRIORITY INFORMATION

This application is a continuation of U.S. patent application Ser. No. 16/723,779, filed Dec. 20, 2019, which is a continuation of U.S. patent application Ser. No. 16/171,300, filed Oct. 25, 2018, now U.S. Pat. No. 10,519,618, which is a continuation of U.S. patent application Ser. No. 15/400,837, filed Jan. 6, 2017, now U.S. Pat. No. 10,113,289, which claims benefit of priority of U.S. Provisional Application Ser. No. 62/276,018, filed Jan. 7, 2016, which are hereby incorporated by reference herein in their entirety.

BACKGROUND

Technical Field

This disclosure relates generally to forms for constructing subsurface structural elements that redirect soil forces.

Description of the Related Art

Foundations typically form the lowest part of an architectural structure and are generally either shallow or deep. Foundations are also sometimes called basework, for example, in the context of large structures. Foundations may be constructed using forms (or formwork). Forms are molds into which concrete (or another material) may be poured to shape the concrete to a desired shape.

SUMMARY OF EMBODIMENTS

Some embodiments may include a form for constructing at least a portion of a structural foundation. The form may include one or more wall forming portions configured to shape a foundation material (e.g., concrete) to form one or more respective walls of at least one subsurface structural element (e.g., a subsurface beam, a subsurface pile, etc.) of the foundation. The form may be configured to shape, based at least in part on the wall forming portions, the subsurface structural element such that the subsurface structural element extends from a surface-level base of the foundation to a subsurface level. Furthermore, the form may be configured to shape, based at least in part on the wall forming portions, the subsurface structural element such that the subsurface structural element is configured to redirect soil forces to vertically displace the foundation rather than have the soil forces crack or otherwise damage the foundation.

Some embodiments may include a foundation for supporting a structure. For instance, the foundation may include a base (e.g., a surface-level base) and at least one subsurface structural element (e.g., a subsurface beam, a subsurface pile, etc.). The subsurface structural element(s) may extend from the base to a subsurface level. Furthermore, the subsurface structural element may be shaped such that it redirects soil forces to vertically displace the foundation. In some cases, the subsurface structural element(s) may include a triangular cross section and/or a trapezoidal cross section.

Some embodiments may include a method of constructing a foundation. The method may include forming at least one subsurface structural element (e.g., a subsurface beam, a subsurface pile, etc.) that extends from a surface-level base of the foundation to a subsurface level. The subsurface structural element may be configured to redirect soil forces to vertically displace the foundation.

Figure 1:
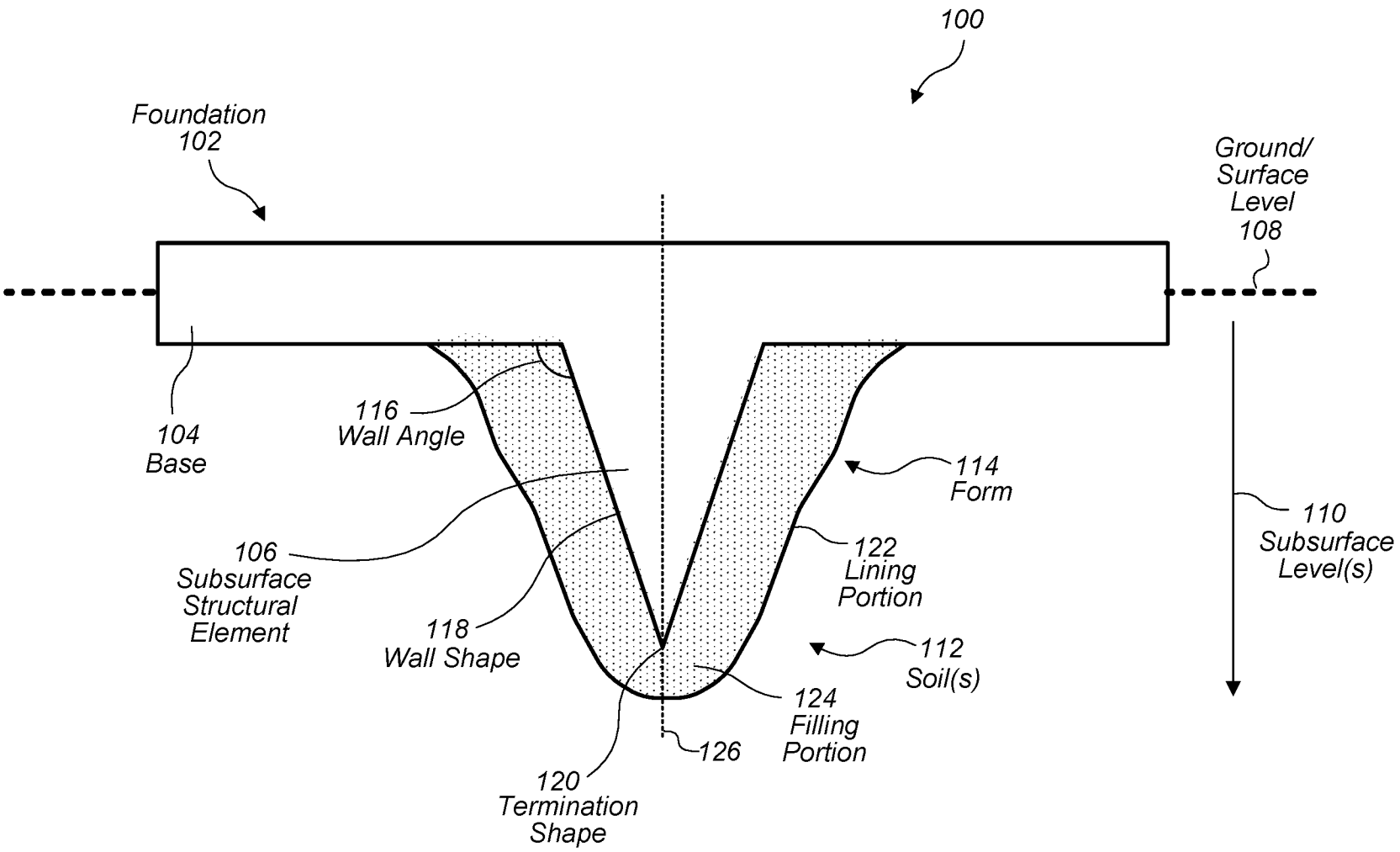
FIG. 1 is a cross-sectional side view illustrating an example environment in which a form is used to construct a subsurface structural element that redirects soil forces, in accordance with some embodiments.

This specification includes references to "one embodiment" or "an embodiment." The appearances of the phrases "in one embodiment" or "in an embodiment" do not necessarily refer to the same embodiment. Particular features, structures, or characteristics may be combined in any suitable manner consistent with this disclosure.

"Comprising." This term is open-ended. As used in the appended claims, this term does not foreclose additional structure or steps. Consider a claim that recites: "An apparatus comprising one or more processor units . . . ". Such a claim does not foreclose the apparatus from including additional components (e.g., a network interface unit, graphics circuitry, etc.).

"Configured To." Various units, circuits, or other components may be described or claimed as "configured to" perform a task or tasks. In such contexts, "configured to" is used to connote structure by indicating that the units/circuits/components include structure (e.g., circuitry) that performs those task or tasks during operation. As such, the unit/circuit/component can be said to be configured to perform the task even when the specified unit/circuit/component is not currently operational (e.g., is not on). The units/circuits/components used with the "configured to" language include hardware—for example, circuits, memory storing program instructions executable to implement the operation, etc. Reciting that a unit/circuit/component is "configured to" perform one or more tasks is expressly intended not to invoke 35 U.S.C. § 112, sixth paragraph, for that unit/circuit/component. Additionally, "configured to" can include generic structure (e.g., generic circuitry) that is manipulated by software and/or firmware (e.g., an FPGA or a general-purpose processor executing software) to operate in manner that is capable of performing the task(s) at issue. "Configure to" may also include adapting a manufacturing process (e.g., a semiconductor fabrication facility) to fabricate devices (e.g., integrated circuits) that are adapted to implement or perform one or more tasks.

"First," "Second," etc. As used herein, these terms are used as labels for nouns that they precede, and do not imply any type of ordering (e.g., spatial, temporal, logical, etc.). For example, a buffer circuit may be described herein as performing write operations for "first" and "second" values. The terms "first" and "second" do not necessarily imply that the first value must be written before the second value.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While in this case, B is a factor that affects the determination of A, such a phrase does not foreclose the determination of A from also being based on C. In other instances, A may be determined based solely on B.

DETAILED DESCRIPTION

Embodiments described herein relate to construction of subsurface structural elements that are configured to redirect soil forces. For instance, a form may be configured to form a subsurface structural element such that the subsurface structural element redirects soil forces to vertically displace a foundation rather than have the soil forces crack or otherwise damage the foundation. The soil forces may include force vectors generated while the soils expand against walls/surfaces of the subsurface structural element. In some embodiments, the soil forces generated by expansive soils while expanding against the sides of the subsurface structural element are less than 90 degrees to the surface of the subsurface structural element, thus creating both a horizontal force vector and a vertical force vector, with the vertical force vector causing the foundation to shift or move vertically.

Some embodiments include a form for constructing at least a portion of a structural foundation (also referred to herein as the "foundation"). As used herein, the term "foundation" may refer to any type of load bearing architectural structure, including but not limited to footings, concrete slabs, concrete slab-on-grade, impact driven piles, drilled shafts, caissons, helical piles, geo-piers, and earth stabilized columns.

The form may include one or more wall forming portions configured to shape a foundation material (e.g., concrete) to form one or more respective walls of at least one subsurface structural element (e.g., a subsurface beam, a subsurface pile, etc.) of the foundation. The form may be configured to shape, based at least in part on the wall forming portions, the subsurface structural element such that the subsurface structural element extends from a surface-level base of the foundation to a subsurface level. Furthermore, the form may be configured to shape, based at least in part on the wall forming portions, the subsurface structural element such that the subsurface structural element is configured to redirect soil forces to vertically displace the foundation.

In some embodiments, the wall forming portions may include a first wall forming portion and a second wall forming portion. The first wall forming portion may be configured to shape the foundation material to form a first surface (e.g., a planar surface, a concave surface, a convex surface, etc.) of a first wall of the subsurface structural element. The first surface may be formed, via the first wall forming portion, such that it includes a first top portion that meets the surface-level base at a first non-zero angle, and a first bottom portion that is opposite the first top portion. The second wall forming portion may be configured to shape the foundation material to form a second surface (e.g., a planar surface, a concave surface, a convex surface, etc.) of a second wall of the subsurface structural element. The second surface may be formed, via the second wall forming portion, such that it includes a second top portion that meets the surface-level base at the first non-zero angle (or a different angle), and a second bottom portion that is opposite the second top portion. In some examples, the second bottom portion may meet the first bottom portion at a second non-zero angle. The first non-zero angle and the second non-zero angle may be the same in some cases. However, in other cases, the first non-zero angle and the second non-zero angle may be different.

In some examples, the form may include one or more termination forming portions configured to shape the foundation material to form one or more respective termination portions of at least one subsurface structural element. The termination portions may be formed, via the termination forming portions, such that each of the termination portions is adjacent to a bottom portion of at least one of the respective walls.

According to some embodiments, the form may include a lining portion and/or a filling portion. The lining portion may include at least one lining that is adjacent to subsurface soil. The filling portion may include a filling material that at least partially fills a gap between at least one subsurface structural element and the lining portion or the subsurface soil. In some examples, the wall forming portions of the form may include at least part of the filling portion. For instance, the filling portion may define a form boundary that may function, at least in part, as the wall forming portions.

In some embodiments, the lining portion may include multiple linings. For example, the lining portion may include a first lining that is adjacent to the subsurface soil and a second lining. Furthermore, the lining portion may include a third lining and/or a friction reducing agent (e.g., a lubricant). The third lining may be located between the first lining and the second lining. For instance, the third lining may be configured to reduce friction between the first lining and the second lining. Likewise, the friction reducing agent may be disposed between the first lining and the second lining. For instance, the friction reducing agent may be configured to form a friction reducing layer between the first lining and the second lining.

In various embodiments, the form may be a soil form. For instance, soil may be excavated to define a cavity that may be used as a form to receive and shape the foundation material. Additionally, or alternatively, the form may be a removable form that may be removed from the foundation (e.g., after the foundation is constructed using the form) and/or a permanent form that is intended to permanently remain with the foundation.

Some embodiments may include a foundation for supporting a structure. For instance, the foundation may include a base (e.g., a surface-level base) and at least one subsurface structural element (e.g., a subsurface beam, a subsurface pile, etc.). The subsurface structural element(s) may extend from the base to a subsurface level. Furthermore, the subsurface structural element may be shaped such that it redirects soil forces to vertically displace the foundation. In some cases, the subsurface structural element(s) may include a triangular cross section and/or a trapezoidal cross section.

In some examples, at least a portion of the base may extend along a horizontally oriented plane. Additionally, or alternatively, the subsurface structural element may be symmetrical about a vertically oriented plane.

In some embodiments, the subsurface structural element may include a first surface and a second surface, each of which may be planar, concave, convex, etc. The first surface may include a first top portion that meets the base at a first non-zero angle, and a first bottom portion that is opposite the first top portion. The second surface may include a second top portion that meets the base at the first non-zero angle (or a different angle), and a second bottom portion that is opposite the second top portion. In some examples, the second bottom portion may meet the first bottom portion at a second non-zero angle. The first non-zero angle and the second non-zero angle may be the same in some cases. However, in other cases, the first non-zero angle and the second non-zero angle may be different.

In some embodiments, the subsurface structural element may include a third surface (e.g., a planar surface, a concave surface, a convex surface, etc.) that extends from the first bottom portion to the second bottom portion. For instance, the third surface may be included in the subsurface structural element instead of the first bottom portion directly meeting with the second bottom portion. In some instances, the third surface may at least partially define a termination portion of the subsurface structural element.

In some examples, the subsurface structural element(s) may include a beam and/or a pile. For instance, the beam may have a longest dimension that extends substantially parallel to at least a portion of the base. The pile may have a longest dimension that extends substantially perpendicular to at least a portion of the base.

Some embodiments may include a method of constructing a foundation. The method may include forming at least one subsurface structural element (e.g., a subsurface beam, a subsurface pile, etc.) that extends from a surface-level base of the foundation to a subsurface level. The subsurface structural element may be configured to redirect soil forces to vertically displace the foundation.

In various embodiments, the method may include excavating a ground area to produce a cavity that is at least partially defined by subsurface soil. Furthermore, the method may include placing a form within the cavity, and pouring concrete within the form. The form may be configured to shape the concrete to form the subsurface structural element.

In some embodiments, the method may include constructing a form. For instance, construction of the form may include excavating a ground area to produce a cavity that is at least partially defined by surface soil, placing one or more linings within the cavity to form a lining layer, and/or filling a portion of the cavity with a filling material to form a filling layer. In some instances, one or more linings may be placed within the cavity such that at least one of the linings is adjacent to the subsurface soil.

In some implementations, the method may include calculating one or more Atterberg limits (e.g., a shrinkage limit, a plastic limit, and/or a liquid limit) corresponding to soil within the subsurface level. Furthermore, the method may include determining one or more design variables associated with the subsurface structural element based at least in part on the calculated Atterberg limit(s). In some cases, the subsurface structural element may be formed based at least in part on the determined design parameter(s).

FIG. 1 is a cross-sectional side view illustrating an example environment 100 in which a form is used to construct a subsurface structural element (e.g., a subsurface beam, a subsurface pile, etc.) that redirects soil forces, in accordance with some embodiments. As illustrated in FIG. 1, a foundation 102 may include a base 104 and a subsurface structural element 106. The base 104 may extend along the ground 108 (also referred to herein as the "surface level"). The subsurface structural element 106 may be configured to extend from the base 104 to a subsurface level 110. Furthermore, the subsurface structural element 106 may be configured to redirect soil forces to vertically displace the foundation 102. For instance, the soil forces may include force vectors generated while the soil(s) 112 (e.g., subsurface soil surrounding the subsurface structural element 106) expand against walls/surfaces of the subsurface structural element 106.

In various embodiments, a form 114 may be used to construct at least a portion of the foundation 102. For instance, the form 114 may be used to construct the subsurface structural element 106. In some examples, the form 114 may be a soil form, a removable form, and/or a permanent form. In some embodiments, the form may be constructed of wood, metal, plastic, fiber glass, and/or resins, etc.

As will be discussed in further detail below with reference to FIG. 2, the form 114 may be used to shape a foundation material (e.g., concrete) to form a subsurface structural element 114 based on one or more design variables. For example, the design variables may include a wall angle 116, a wall shape 118, and/or a termination shape 120. As illustrated in FIG. 1, a wall (having the wall shape 118) of the subsurface structural element 114 may meet the base 104 at a non-zero angle (the wall angle 116). In a non-limiting example, the wall angle 116 may be greater than 90 degrees and the wall shape 118 may be straight. Furthermore, the termination shape 120 of the subsurface structural element 114 may be a point. In this non-limiting example, the subsurface structural element 114 has a triangular cross section and/or a "v-shaped" cross section. However, as discussed below with reference to FIG. 2, the wall angle 116, the wall shape 118, and/or the termination shape 120 may be different in other embodiments.

As illustrated in FIG. 1, in some embodiments the form 114 may include a lining portion 122 and/or a filling portion 124. The lining portion 122 may include at least one lining that is adjacent to subsurface soil 112. The filling portion 124 may include a filling material that at least partially fills a gap between the subsurface structural element 106 and the lining portion 122 or the subsurface soil 112. In some examples, portions of the form 114 that are configured to form walls of the subsurface structural element 106 (also referred to herein as the "wall forming portions" of the form) may include at least part of the filling portion 124. For instance, the filling portion 124 may define a form boundary that may function, at least in part, as the wall forming portions.

In some embodiments, the lining portion 122 may include multiple linings. For example, the lining portion 122 may include a first lining that is adjacent to the subsurface soil 112 and a second lining. Furthermore, the lining portion 122 may include a third lining and/or a friction reducing agent (e.g., a lubricant). The third lining may be located between the first lining and the second lining. For instance, the third lining may be configured to reduce friction between the first lining and the second lining. Likewise, the friction reducing agent may be disposed between the first lining and the second lining. For instance, the friction reducing agent may be configured to form a friction reducing layer between the first lining and the second lining.

In some examples, at least a portion of the base 104 may extend along a horizontally oriented plane (e.g., a plane that is orthogonal to the page of FIG. 1 and coincident with the broken line corresponding to the surface level 108). Additionally, or alternatively, the subsurface structural element 106 may be symmetrical about a vertically oriented plane (e.g., a plane that is orthogonal to the page of FIG. 1 and coincident with broke line 126).

Figure 2:
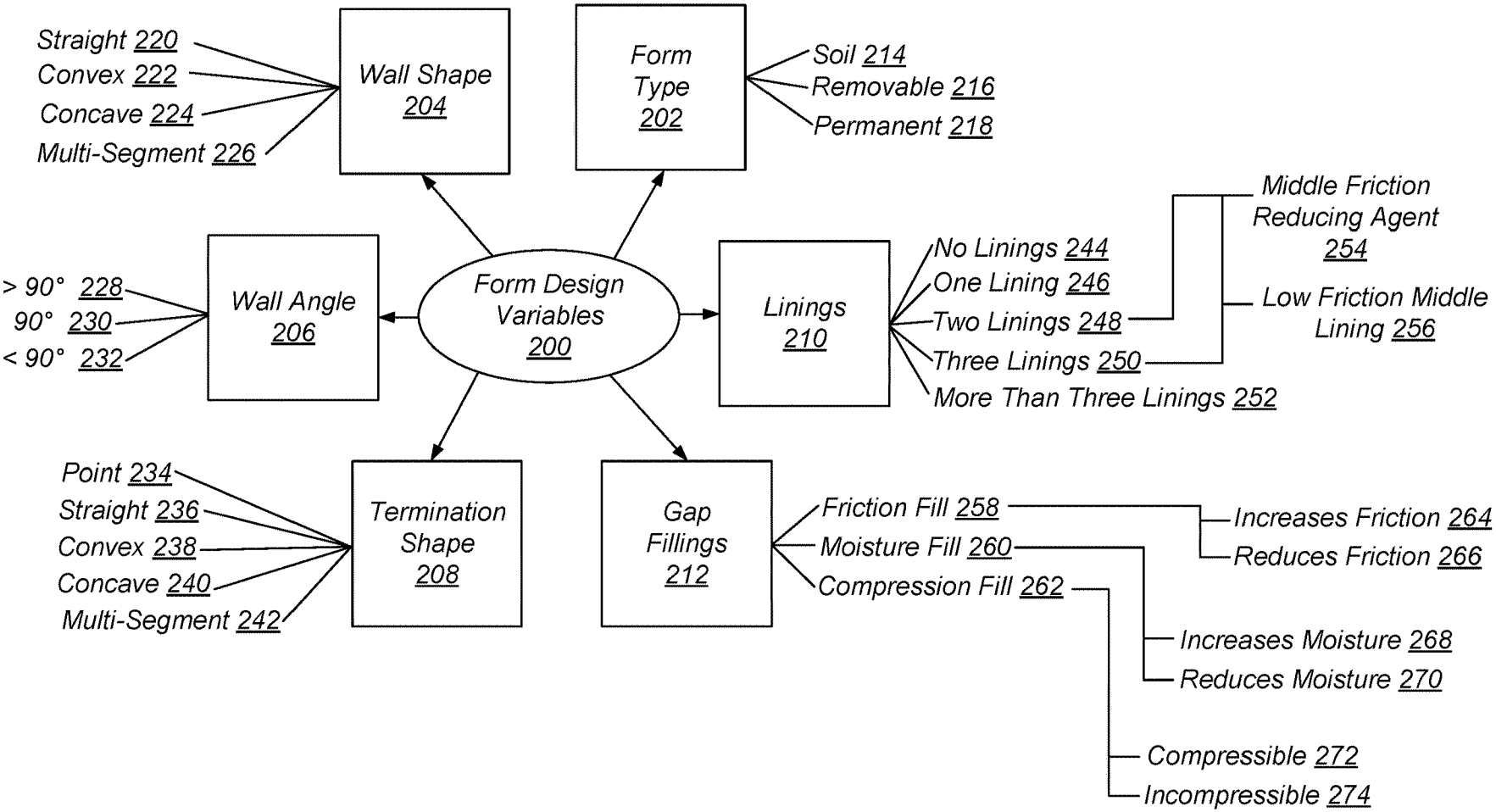
FIG. 2 is a map providing example design variables that may be considered in the design of a form for constructing a subsurface structural element that redirects soil forces, in accordance with some embodiments.

FIG. 2 is a map providing example design variables 200 that may be considered in the design of a form for constructing a subsurface structural element that redirects soil forces, in accordance with some embodiments. For instance, one or more of the design variables 200 may be considered in the design of the forms described with reference to FIGS. 1, 3-10, 12, and 13. In the following discussion regarding the design variables 200, reference will be made to both FIGS. 1 and 2 for illustrative purposes.

The design variables 200 may be adjusted based on the desired performance of the subsurface structural element 106 and/or the foundation 102 that is to be constructed. For instance, the design variables 200 may be adjusted to improve performance of the subsurface structural element 106 and/or the foundation 102 in expansive soils and clays. In various embodiments, the design variables 200 may include form type 202, wall shape 204, wall angle 206, termination shape 208, linings 210, and/or gap fillings 212.

In some embodiments, the form type 202 design variables may include a soil form 214, a removable form 216, and/or a permanent form 218. With a soil form 214, the soil 112 itself may be shaped such that the soil 112 serves as a form 114. For instance, soil may be excavated to define a cavity that may be used as a form to receive and shape the foundation material. A removable form 216 may be a form 114 configured to be removed from the subsurface structural element 106 and/or the foundation 102 after construction of the subsurface structural element 106 and/or the foundation 102. A permanent form 218 may be a form 114 that is configured to remain with the subsurface structural element 106 and/or the foundation 102 after construction of the subsurface structural element 106 and/or the foundation 102.

In some examples, the wall shape 204 design variables may include a straight wall 220, a convex wall 222, a concave wall 224, and/or a multi-segment wall 226. For instance, the form 114 may include one or more wall forming portions having straight walls 220. The straight walls 220 may be configured to shape a foundation material to form corresponding straight walls of the subsurface structural element 106. Additionally, or alternatively, the form 114 may include one or more wall forming portions having convex walls 222. The convex walls 222 may be configured to shape the foundation material to form corresponding convex walls of the subsurface structural element 106. Additionally, or alternatively, the form 114 may include one or more wall forming portions having concave walls 224. The concave walls 224 may be configured to shape the foundation material to form corresponding concave walls of the subsurface structural element 106.

In some embodiments, the form 114 may include one or more wall forming portions having multi-segment walls 226. The multi-segment walls 226 may include multiple segments of straight walls 220, convex walls 222, concave walls 224, or combinations thereof.

In various embodiments, the wall angle 206 design variables may include a greater than 90 degrees wall angle 228, a 90 degrees wall angle 230, and/or a less than 90 degrees wall angle 232. The wall angle 206 design variables may refer to the angle at which a wall forming portion of the form 114 meets the base 104 of the foundation 102 or a base forming portion of the form 114. Additionally, or alternatively, the wall angle 206 design variables may refer to the angle at which a wall of the resulting subsurface structural element 106 (i.e., the subsurface structural element 106 that is to be formed using the form 114) is to meet the base 104 of the foundation 102. In FIG. 1, the wall angle 116 is depicted as a greater than 90 degrees wall angle 228. However, in some embodiments, the wall angle 116 may be a 90 degree wall angle 230 or a less than 90 degree wall angle 232.

In some embodiments, the termination shape 208 design variables may include a point termination shape 234, a straight termination shape 236, a convex termination shape 238, a concave termination shape 240, and/or a multi-segment termination shape 242. The termination shape 208 design variables may refer to a shape of a termination forming portion of the form 114. Additionally, or alternatively, the termination shape 208 design variables may refer to a shape of a termination portion of the resulting subsurface structural element 106 (i.e., the subsurface structural element 106 that is to be formed using the form 114). In some examples, the form 114 may include one or more termination forming portions configured to shape the foundation material to form one or more respective termination portions of the subsurface structural element. In some cases, each of the termination portions may be adjacent to a bottom portion of a wall of the subsurface structural element 106.

In FIG. 1, the termination shape 120 is depicted as a point termination shape 234. Opposing walls of the form 114 may each have a respective bottom portion, and the bottom portions may meet at a point, forming a V-shape. Correspondingly, opposing walls of the subsurface structural element 106 may each have a respective bottom portion, and the bottom portions may meet at a point, forming a V-shape. However, in some embodiments, the termination shape 120 may be a convex termination shape 238, a concave termination shape 240, and/or a multi-segment termination shape 242.

In various examples, the linings 210 design variables may include no linings 244, one lining 246, two linings 248, three linings 250, and/or more than three linings 252. As discussed above with reference to FIG. 1, in some embodiments the form 114 may include a lining portion 122. The lining portion 122 may include at least one lining that is adjacent to subsurface soil 112. In a particular non-limiting example, the lining portion 122 may include two linings 248 and a middle friction reducing agent 254 disposed between the two linings 248. The middle friction reducing agent 254 may be configured to reduce friction between the two linings 248. For instance, the middle friction reducing agent 254 may be a lubricant.

According to another particular non-limiting example, the lining portion 122 may include three linings 250. For instance, a low friction middle lining 256 may be disposed between two other linings to ease movement between the two other linings. The low friction middle lining 256 may have a low coefficient of friction to reduce friction between the two other linings. In some cases, a middle friction reducing agent 254 may function as a low friction middle lining 256.

Additionally, or alternatively, a middle friction increasing agent and/or a high friction middle lining may be disposed between two linings to increase friction between the two linings.

In some embodiments, the gap fillings 212 design variables may include a friction fill 258, a moisture fill 260, and/or a compression fill 262. As discussed above with reference to FIG. 1, in some embodiments the form 114 may include a filling portion 124. The filling portion 124 may include a filling material that at least partially fills a gap between the subsurface structural element 106 and the lining portion 122 or the subsurface soil 112. In some examples, wall forming portions of the form 114 may include at least part of the filling portion 124. For instance, the filling portion 124 may define a form boundary that may function, at least in part, as the wall forming portions.

In some examples, the filling material may comprise a friction fill material 258. In some embodiments, the friction fill material 258 may be configured to increase friction 264 between the soil 112 and the subsurface structural element 106. In other embodiments, the friction fill material 258 may be configured to reduce friction between the soil 112 and the subsurface structural element 106.

Additionally, or alternatively, the filling material may comprise a moisture fill material 260. In some embodiments, the moisture fill material 260 may be configured to increase moisture 268 of the soil 112 around the subsurface structural element 106. In other embodiments, the moisture fill material 260 may be configured to reduce moisture 270 of the soil 112 around the subsurface structural element 106.

Additionally, or alternatively, the filling material may comprise a compression fill material 262. In some embodiments, the compression fill material 262 may be compressible 272 to absorb soil forces before they reach the subsurface structural element 106. In other embodiments, the compression fill material 262 may be incompressible 274, or substantially incompressible, such that the compression fill material 262 transmits soil forces directly to the subsurface structural element 106 with little or no loss of force.

It should be understood that the filling material may have one or more of the properties described above with reference to the friction fill material 258, moisture fill material 260, and the compression fill material 262. For instance, a filling material may both reduce friction 266 and be incompressible 274, such as smooth, round rocks.

In some embodiments, no filling material may be used to fill the gap between the subsurface structural element 106 and the lining portion 122 or the subsurface soil 112. That is, the gap may comprise an unfilled void or empty space between the soil 112 (or the lining portion 122) and the subsurface structural element 106.

Figure 3:
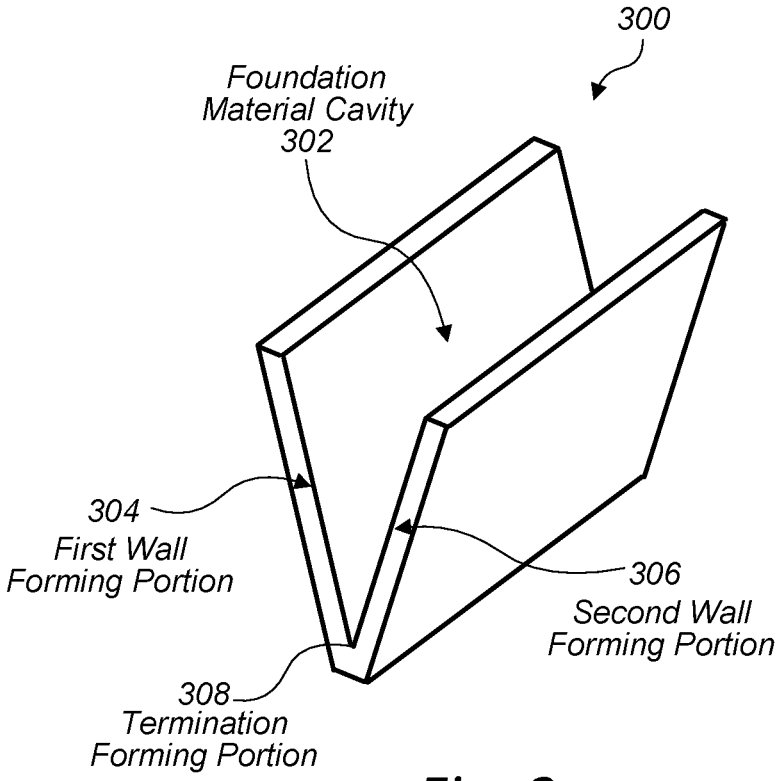
FIG. 3 is a perspective view illustrating an example form for constructing a subsurface structural element that redirects soil forces, in accordance with some embodiments.

FIG. 3 is a perspective view illustrating an example form 300 for constructing a subsurface structural element that redirects soil forces, in accordance with some embodiments. The subsurface structural element may be part of a foundation. For instance, the foundation may include a base at a surface level, and the subsurface structural element may extend from the surface-level base to a subsurface level. In various embodiments, the form 300 may include a foundation material cavity 302 configured to receive a foundation material (e.g., concrete) to form a V-shaped subsurface structural element, such as the subsurface structural element 400 discussed below with reference to FIG. 4. Furthermore, the form 300 may include features, materials, and/or properties of embodiments of forms described herein with reference to FIGS. 1, 2, and 11A-13.

In some examples, the form 300 may include one or more wall forming portions configured to shape the foundation material to form one or more respective walls of the subsurface structural element. The form 300 may be configured to shape, based at least in part on the wall forming portions, the subsurface structural element such that the subsurface structural element extends from the surface-level base of the foundation to a subsurface level. Furthermore, the form 300 may be configured to shape, based at least in part on the wall forming portions, the subsurface structural element such that the subsurface structural element is configured to redirect soil forces to vertically displace the foundation.

In some embodiments, the wall forming portions may include a first wall forming portion 304 and a second wall forming portion 306. The first wall forming portion 304 may be configured to shape the foundation material to form a first surface of a first wall of the subsurface structural element. The first surface may be formed, via the first wall forming portion 304, such that it includes a first top portion that meets the surface-level base at a first non-zero angle, and a first bottom portion that is opposite the first top portion. The second wall forming portion 306 may be configured to shape the foundation material to form a second surface of a second wall of the subsurface structural element. The second surface may be formed, via the second wall forming portion, such that it includes a second top portion that meets the surface-level base at the first non-zero angle (or a different angle), and a second bottom portion that is opposite the second top portion. In some examples, the second bottom portion may meet the first bottom portion at a second non-zero angle. The first non-zero angle and the second non-zero angle may be the same in some cases. However, in other cases, the first non-zero angle and the second non-zero angle may be different.

In some examples, the form 300 may include a termination forming portion 308 configured to shape the foundation material to form a corresponding termination portion of the subsurface structural element. As illustrated in FIG. 3, the termination forming portion 308 may be configured to shape the foundation material to form a termination portion of the subsurface structural element that has a point termination shape.

In various embodiments, the form 300 may be used to construct a subsurface structural element that is V-shaped and/or a subsurface structural element that has a triangular cross-section. In some examples, the form 300 may be used to construct a subsurface beam.

Figure 4:
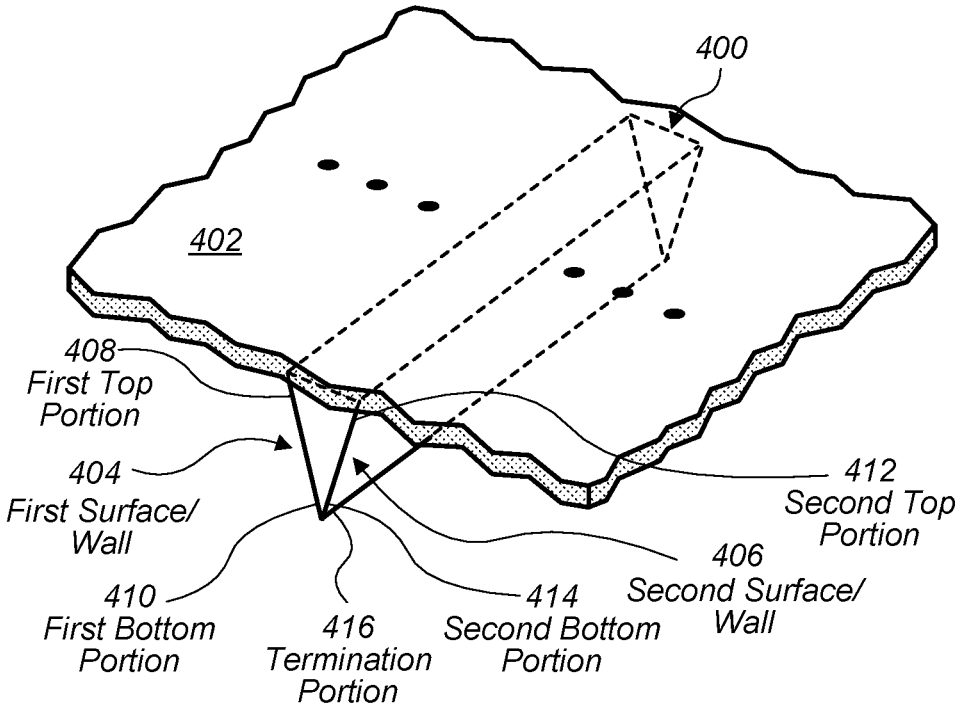
FIG. 4 is a perspective view illustrating an example subsurface structural element that is configured to redirect soil forces, in accordance with some embodiments.

FIG. 4 is a perspective view illustrating an example subsurface structural element 400 that is configured to redirect soil forces, in accordance with some embodiments. For instance, the subsurface structural element 400 may be constructed using the form 300 discussed above with reference to FIG. 3. The subsurface structural element 400 may be part of a foundation. For example, the foundation may include a base 402 at a surface level, and the subsurface structural element 400 may extend from the surface-level base to a subsurface level. Furthermore, the subsurface structural element 400 may be shaped such that it redirects soil forces to vertically displace the foundation. The subsurface structural element 400 may include features, materials, and/or properties of embodiments of subsurface structural elements described herein with reference to FIGS. 1, 2, and 11A-13.

In some embodiments, the subsurface structural element 400 may include a first surface 404 and a second surface 406. The first surface 404 may include a first top portion 408 that meets the base 402 at a first non-zero angle, and a first bottom portion 410 that is opposite the first top portion 408. For instance, as illustrated in FIG. 4, the first non-zero angle at which the first top portion 408 meets the base 402 may be greater than 90 degrees. The second surface 406 may include a second top portion 412 that meets the base 402 at the first non-zero angle (or a different angle), and a second bottom portion 414 that is opposite the second top portion 412. In some examples, the second bottom portion 414 may meet the first bottom portion 410 at a second non-zero angle, e.g., to form a termination portion that has a point termination shape as illustrated in FIG. 4. The first non-zero angle and the second non-zero angle may be the same in some cases. However, in other cases, the first non-zero angle and the second non-zero angle may be different.

In various embodiments, the subsurface structural element 400 may be V-shaped and/or have a triangular cross-section such that it is capable of redirecting soil forces to vertically displace the foundation. In some examples, the subsurface structural element 400 may be a beam that has a longest dimension that extends substantially parallel to at least a portion of the base 402.

Figure 5:
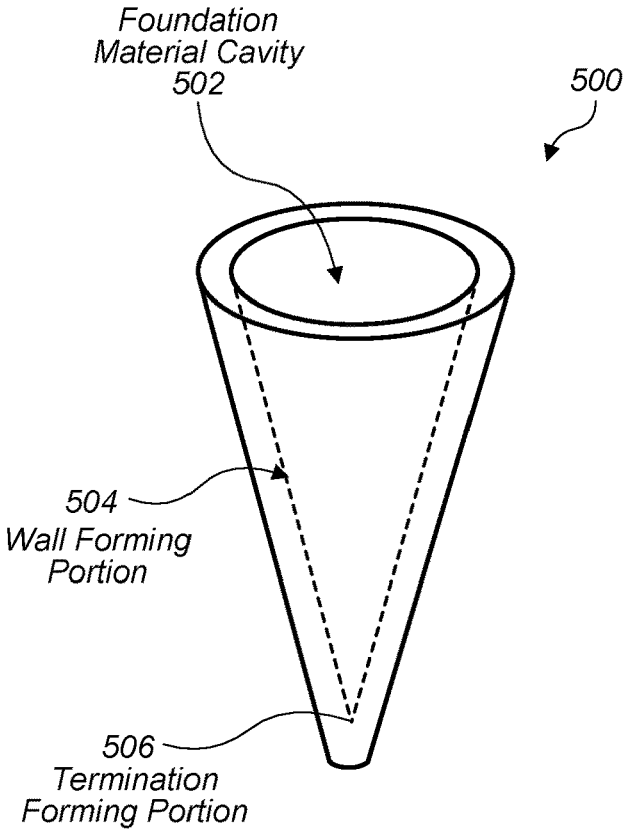
FIG. 5 is a perspective view illustrating another example form for constructing a subsurface structural element that redirects soil forces, in accordance with some embodiments.

FIG. 5 is a perspective view illustrating another example form 500 for constructing a subsurface structural element that redirects soil forces, in accordance with some embodiments. The subsurface structural element may be part of a foundation. For instance, the foundation may include a base at a surface level, and the subsurface structural element may extend from the surface-level base to a subsurface level. In various embodiments, the form 500 may include a foundation material cavity 502 configured to receive a foundation material (e.g., concrete) to form a conical subsurface structural element, such as the subsurface structural element 600 discussed below with reference to FIG. 6. Furthermore, the form 500 may include features, materials, and/or properties of embodiments of forms described herein with reference to FIGS. 1, 2, and 11A-13.

In some examples, the form 500 may include a wall forming portion 504 configured to shape the foundation material to form a conical wall of the subsurface structural element. The form 500 may be configured to shape, based at least in part on the wall forming portion 504, the subsurface structural element such that the subsurface structural element extends from the surface-level base of the foundation to a subsurface level. Furthermore, the form 500 may be configured to shape, based at least in part on the wall forming portion 504, the subsurface structural element such that the subsurface structural element is configured to redirect soil forces to vertically displace the foundation.

In some examples, the form 500 may include a termination forming portion 506 configured to shape the foundation material to form a corresponding termination portion of the subsurface structural element. As illustrated in FIG. 5, the termination forming portion 506 may be configured to shape the foundation material to form a termination portion of the subsurface structural element that has a point termination shape.

In various embodiments, the form 500 may be used to construct a subsurface structural element that is conical and/or a subsurface structural element that has a triangular cross-section. In some examples, the form 500 may be used to construct a sub surface conical pile.

Figure 6:
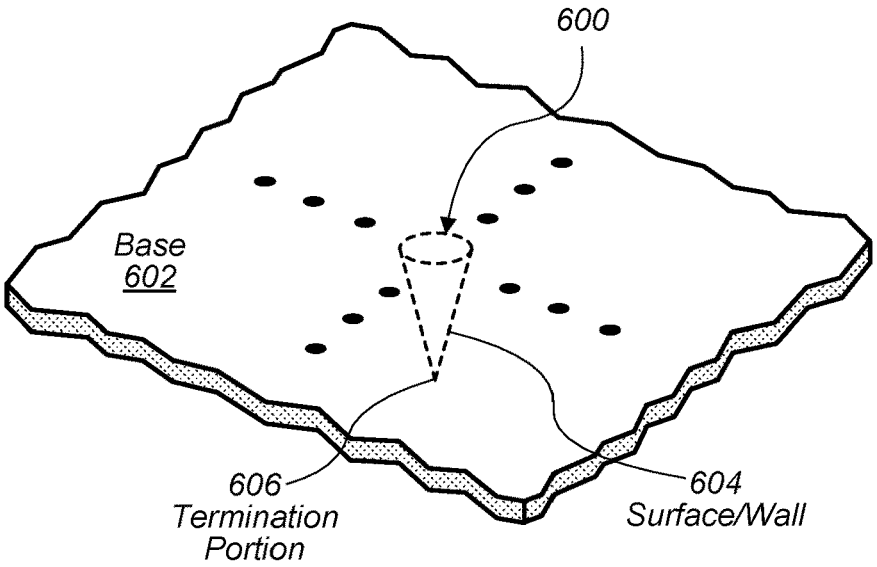
FIG. 6 is a perspective view illustrating another example subsurface structural element that is configured to redirect soil forces, in accordance with some embodiments.

FIG. 6 is a perspective view illustrating another example subsurface structural element 600 that is configured to redirect soil forces, in accordance with some embodiments. For instance, the subsurface structural element 600 may be constructed using the form 500 discussed above with reference to FIG. 5. The subsurface structural element 600 may be part of a foundation. For example, the foundation may include a base 602 at a surface level, and the subsurface structural element 600 may extend from the surface-level base to a subsurface level. Furthermore, the subsurface structural element 600 may be shaped such that it redirects soil forces to vertically displace the foundation. The subsurface structural element 600 may include features, materials, and/or properties of embodiments of subsurface structural elements described herein with reference to FIGS. 1, 2, and 11A-13.

In some embodiments, the subsurface structural element 600 may include a conical surface 604. The surface may include a top portion that meets the base 602 at a non-zero angle, and a bottom portion that is opposite the top portion. For instance, as illustrated in FIG. 6, the non-zero angle at which the top portion meets the base 602 may be greater than 90 degrees. The bottom portion may form a termination portion 606. For instance, termination portion 606 may have a point termination shape.

In various embodiments, the subsurface structural element 600 may be conical and/or have a triangular cross-section such that it is capable of redirecting soil forces to vertically displace the foundation. In some examples, the subsurface structural element 600 may be a pile that has a longest dimension that extends substantially perpendicular to at least a portion of the base 602.

Figure 7:
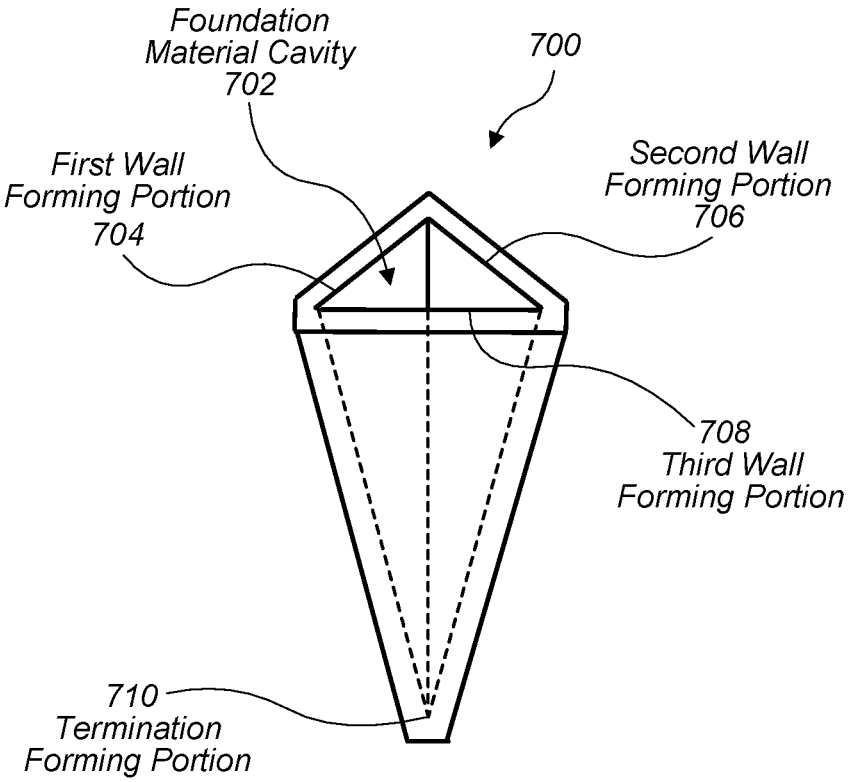
FIG. 7 is a perspective view illustrating yet another example form for constructing a subsurface structural element that redirects soil forces, in accordance with some embodiments.

FIG. 7 is a perspective view illustrating yet another example form 700 for constructing a subsurface structural element that redirects soil forces, in accordance with some embodiments. The subsurface structural element may be part of a foundation. For instance, the foundation may include a base at a surface level, and the subsurface structural element may extend from the surface-level base to a subsurface level. In various embodiments, the form 700 may include a foundation material cavity 702 configured to receive a foundation material (e.g., concrete) to form a pyramidal subsurface structural element, such as the subsurface structural element 800 discussed below with reference to FIG. 8. Furthermore, the form 700 may include features, materials, and/or properties of embodiments of forms described herein with reference to FIGS. 1, 2, and 11A-13.

In some examples, the form 700 may include one or more wall forming portions configured to shape the foundation material to form one or more respective walls of the subsurface structural element. The form 700 may be configured to shape, based at least in part on the wall forming portions, the subsurface structural element such that the subsurface structural element extends from the surface-level base of the foundation to a subsurface level. Furthermore, the form 700 may be configured to shape, based at least in part on the wall forming portions, the subsurface structural element such that the subsurface structural element is configured to redirect soil forces to vertically displace the foundation.

In some embodiments, the wall forming portions may include a first wall forming portion 704, a second wall forming portion 706, and a third wall forming portion 706. The first wall forming portion 704 may be configured to shape the foundation material to form a first surface of a first wall of the subsurface structural element. The second wall forming portion 706 may be configured to shape the foundation material to form a second surface of a second wall of the subsurface structural element. The third wall forming portion 708 may be configured to shape the foundation material to form a third surface of a third wall of the subsurface structural element. As illustrated in FIG. 7, the wall forming portions 704, 706, and 708 may converge at a termination forming portion 710 having a point termination shape to correspondingly shape the foundation material to form a termination portion of the subsurface structural element that has a point termination shape. Furthermore, the wall forming portions 704, 706, and 708 may be configured to shape the foundation material such that the corresponding surfaces/walls of the subsurface structural element meet the base of the foundation at one or more non-zero angles.

In various embodiments, the form 700 may be used to construct a subsurface structural element that is pyramidal and/or a subsurface structural element that has a triangular cross-section. In some examples, the form 700 may be used to construct a sub surface pyramidal pile.

Figure 8:
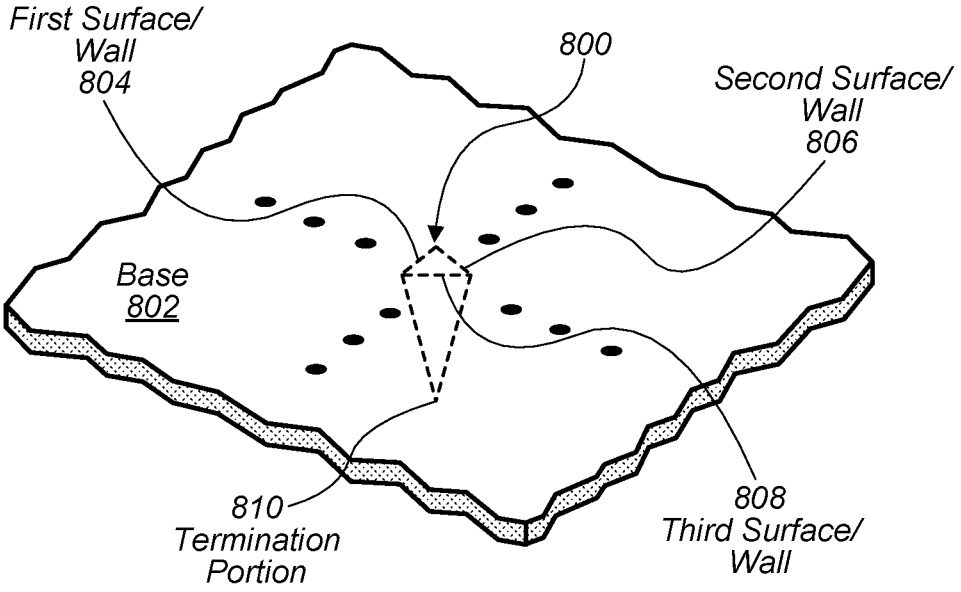
FIG. 8 is a perspective view illustrating yet another example subsurface structural element that is configured to redirect soil forces, in accordance with some embodiments.

FIG. 8 is a perspective view illustrating yet another example subsurface structural element 800 that is configured to redirect soil forces, in accordance with some embodiments. For instance, the subsurface structural element 800 may be constructed using the form 700 discussed above with reference to FIG. 7. The subsurface structural element 800 may be part of a foundation. For example, the foundation may include a base 802 at a surface level, and the subsurface structural element 800 may extend from the surface-level base to a subsurface level. Furthermore, the subsurface structural element 800 may be shaped such that it redirects soil forces to vertically displace the foundation. The subsurface structural element 800 may include features, materials, and/or properties of embodiments of subsurface structural elements described herein with reference to FIGS. 1, 2, and 11A-13.

In some embodiments, the subsurface structural element 800 may include a first surface 804, a second surface 806, and a third surface 808. The first surface 804 may include a first top portion that meets the base 802 at a non-zero angle, and a first bottom portion that is opposite the first top portion. For instance, as illustrated in FIG. 8, the non-zero angle at which the first top portion meets the base 802 may be greater than 90 degrees. The second surface 806 may include a second top portion that meets the base 802 at the non-zero angle (or a different angle), and a second bottom portion that is opposite the second top portion. The third surface 808 may include a third top portion that meets the base 802 at the non-zero angle (or a different angle), and a third bottom portion that is opposite the third top portion.

In various embodiments, the subsurface structural element 800 may be pyramidal and/or have a triangular cross-section such that it is capable of redirecting soil forces to vertically displace the foundation. In some examples, the subsurface structural element 800 may be a pile that has a longest dimension that extends substantially perpendicular to at least a portion of the base 802.

Figure 9:
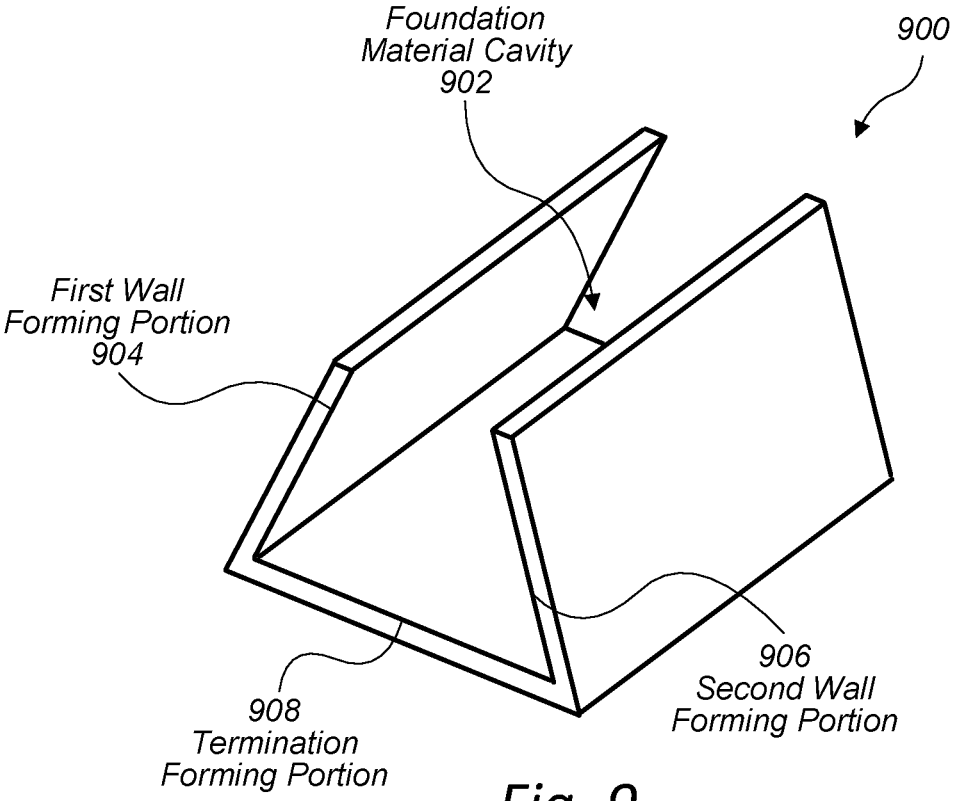
FIG. 9 is a perspective view illustrating still yet another example form for constructing a subsurface structural element that redirects soil forces, in accordance with some embodiments.

FIG. 9 is a perspective view illustrating still yet another example form 900 for constructing a subsurface structural element that redirects soil forces, in accordance with some embodiments. The subsurface structural element may be part of a foundation. For instance, the foundation may include a base at a surface level, and the subsurface structural element may extend from the surface-level base to a subsurface level. In various embodiments, the form 900 may include a foundation material cavity 902 configured to receive a foundation material (e.g., concrete) to form a tapered subsurface structural element, such as the subsurface structural element 1000 discussed below with reference to FIG. 10. Furthermore, the form 900 may include features, materials, and/or properties of embodiments of forms described herein with reference to FIGS. 1, 2, and 11A-13.

In some examples, the form 900 may include one or more wall forming portions configured to shape the foundation material to form one or more respective walls of the subsurface structural element. The form 900 may be configured to shape, based at least in part on the wall forming portions, the subsurface structural element such that the subsurface structural element extends from the surface-level base of the foundation to a subsurface level. Furthermore, the form 900 may be configured to shape, based at least in part on the wall forming portions, the subsurface structural element such that the subsurface structural element is configured to redirect soil forces to vertically displace the foundation.

In some embodiments, the wall forming portions may include a first wall forming portion 904 and a second wall forming portion 906. The first wall forming portion 904 may be configured to shape the foundation material to form a first surface of a first wall of the subsurface structural element. The second wall forming portion 906 may be configured to shape the foundation material to form a second surface of a second wall of the subsurface structural element. As illustrated in FIG. 9, the wall forming portions 904 and 906 may diverge from a top portion of the form 900 to a termination forming portion 908 having a straight termination shape to correspondingly shape the foundation material to form a termination portion of the subsurface structural element that has a straight termination shape. Furthermore, the wall forming portions 904 and 906 may be configured to shape the foundation material such that the corresponding surfaces/walls of the subsurface structural element meet the base of the foundation at one or more non-zero angles.

In various embodiments, the form 900 may be used to construct a subsurface structural element that is tapered and/or a subsurface structural element that has a trapezoidal cross-section. In some examples, the form 900 may be used to construct a sub surface trapezoidal beam.

Figure 10:
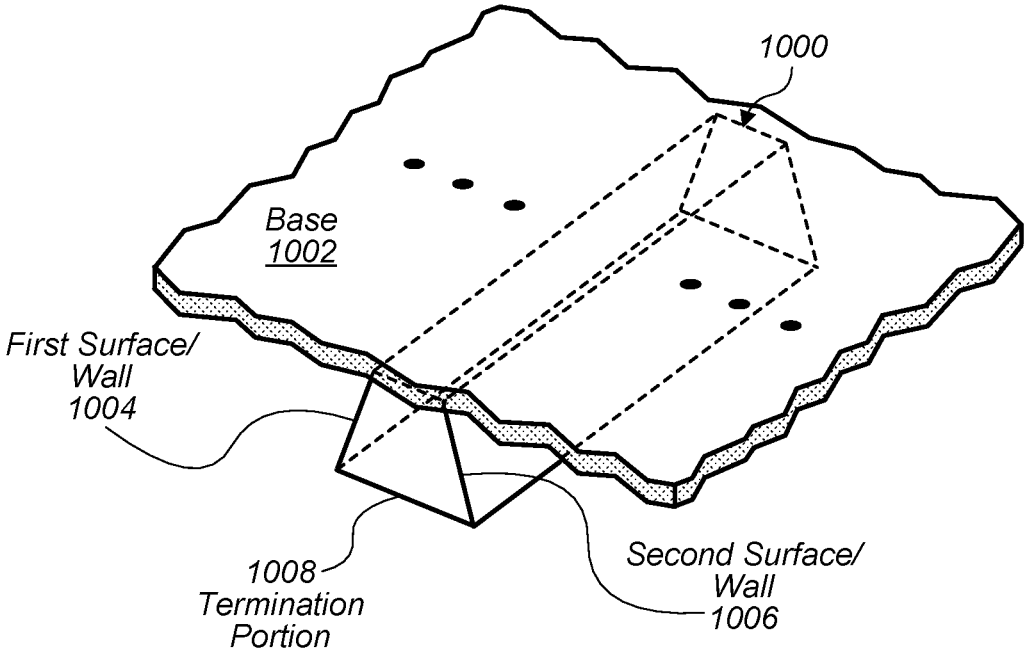
FIG. 10 is a perspective view illustrating still yet another example subsurface structural element that is configured to redirect soil forces, in accordance with some embodiments.

FIG. 10 is a perspective view illustrating still yet another example subsurface structural element 1000 that is configured to redirect soil forces, in accordance with some embodiments. For instance, the subsurface structural element 1000 may be constructed using the form 900 discussed above with reference to FIG. 9. The subsurface structural element 1000 may be part of a foundation. For example, the foundation may include a base 1002 at a surface level, and the subsurface structural element 1000 may extend from the surface-level base to a subsurface level. Furthermore, the subsurface structural element 1000 may be shaped such that it redirects soil forces to vertically displace the foundation. The subsurface structural element 1000 may include features, materials, and/or properties of embodiments of subsurface structural elements described herein with reference to FIGS. 1, 2, and 11A-13.

In some embodiments, the subsurface structural element 1000 may include a first surface 1004 and a second surface 1006. The first surface 1004 may include a first top portion that meets the base 1002 at a non-zero angle, and a first bottom portion that is opposite the first top portion. For instance, as illustrated in FIG. 10, the non-zero angle at which the first top portion meets the base 1002 may be less than 90 degrees. The second surface 1006 may include a second top portion that meets the base 1002 at the non-zero angle (or a different angle), and a second bottom portion that is opposite the second top portion.

In some embodiments, the subsurface structural element may include a third surface that extends from the first bottom portion to the second bottom portion. For instance, the third surface may at least partially define a termination portion 1008 of the subsurface structural element that has a straight termination shape.

In various embodiments, the subsurface structural element 1000 may be tapered and/or have a trapezoidal cross-section such that it is capable of redirecting soil forces to vertically displace the foundation. In some examples, the subsurface structural element 1000 may be a trapezoidal beam that has a longest dimension that extends substantially parallel to at least a portion of the base 1002. Furthermore, the subsurface structural element 1000 may include "locking taper" wall angles that are less than 90 degrees, which may cause expansive soils to grip the subsurface structural element 1000 tightly.

Figure 11A:
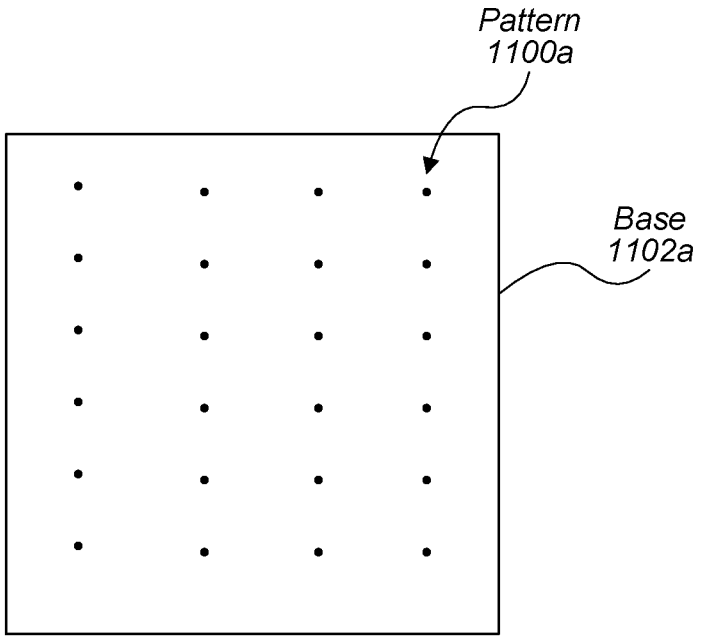
FIGS. 11A-11D illustrate example patterns in which subsurface structural elements may be distributed with respect to a foundation, in accordance with some embodiments.

FIGS. 11A-11D illustrate example patterns in which subsurface structural elements may be distributed with respect to a foundation and/or a base of a foundation, in accordance with some embodiments. In FIG. 11A, the dots of pattern 1100*a* may represent, for example, subsurface piles (e.g., the subsurface conical pile and/or the subsurface pyramidal pile discussed above with reference to FIGS. 6 and 8, respectively). The subsurface piles may be distributed relative to a base 1102*a* of a foundation as indicated by pattern 1100*a*.

Figure 11B:
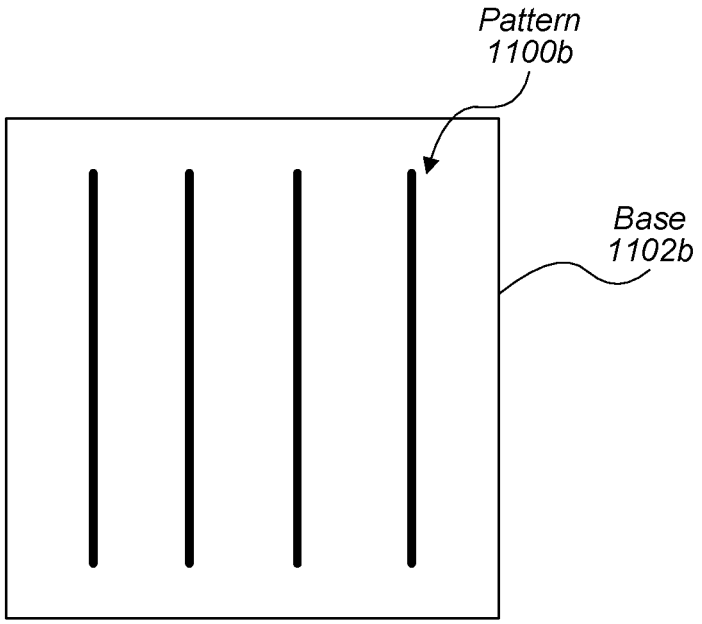

In FIG. 11B, the vertical lines of pattern 1100*b* may represent, for example, subsurface beams (e.g., the subsurface V-shaped beam and/or the subsurface tapered beam discussed above with reference to FIGS. 3 and 9, respectively). The subsurface beams may be distributed relative to a base 1102*b* of a foundation as indicated by pattern 1100*b*.

Figure 11C:
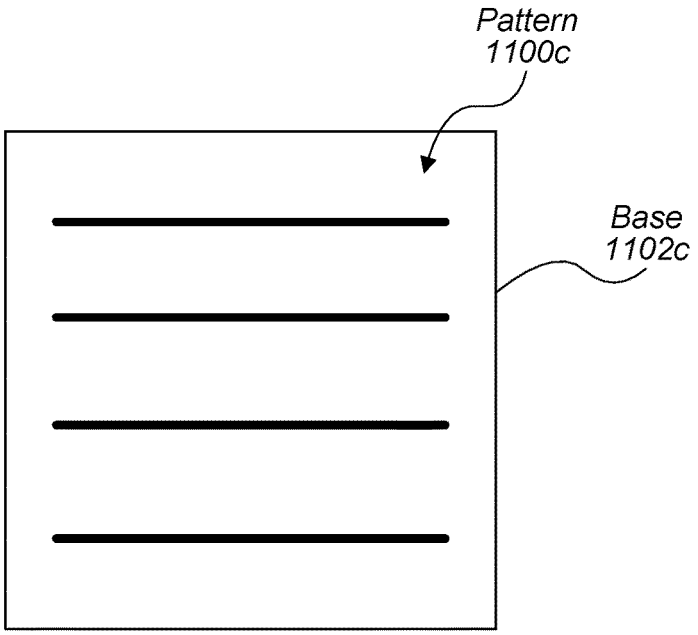

In FIG. 11C, the horizontal lines of pattern 1100*c* may represent, for example, subsurface beams (e.g., the subsurface V-shaped beam and/or the subsurface tapered beam discussed above with reference to FIGS. 3 and 9, respectively). The subsurface beams may be distributed relative to a base 1102*c* of a foundation as indicated by pattern 1100*c*.

Figure 11D:
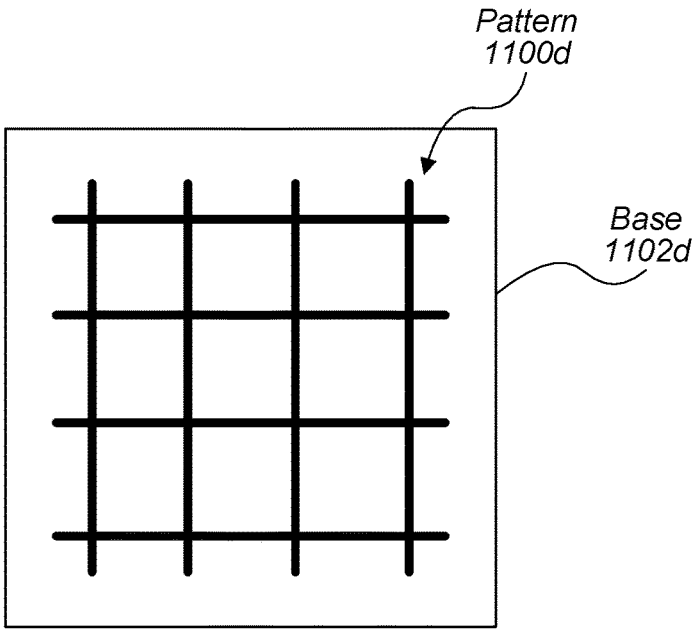

In FIG. 11D, the vertical and horizontal lines of pattern 1100*d* may represent, for example, subsurface beams (e.g., the subsurface V-shaped beam and/or the subsurface tapered beam discussed above with reference to FIGS. 3 and 9, respectively). The subsurface beams may be distributed relative to a base 1102*d* of a foundation as indicated by pattern 1100*d*.

Figure 12:
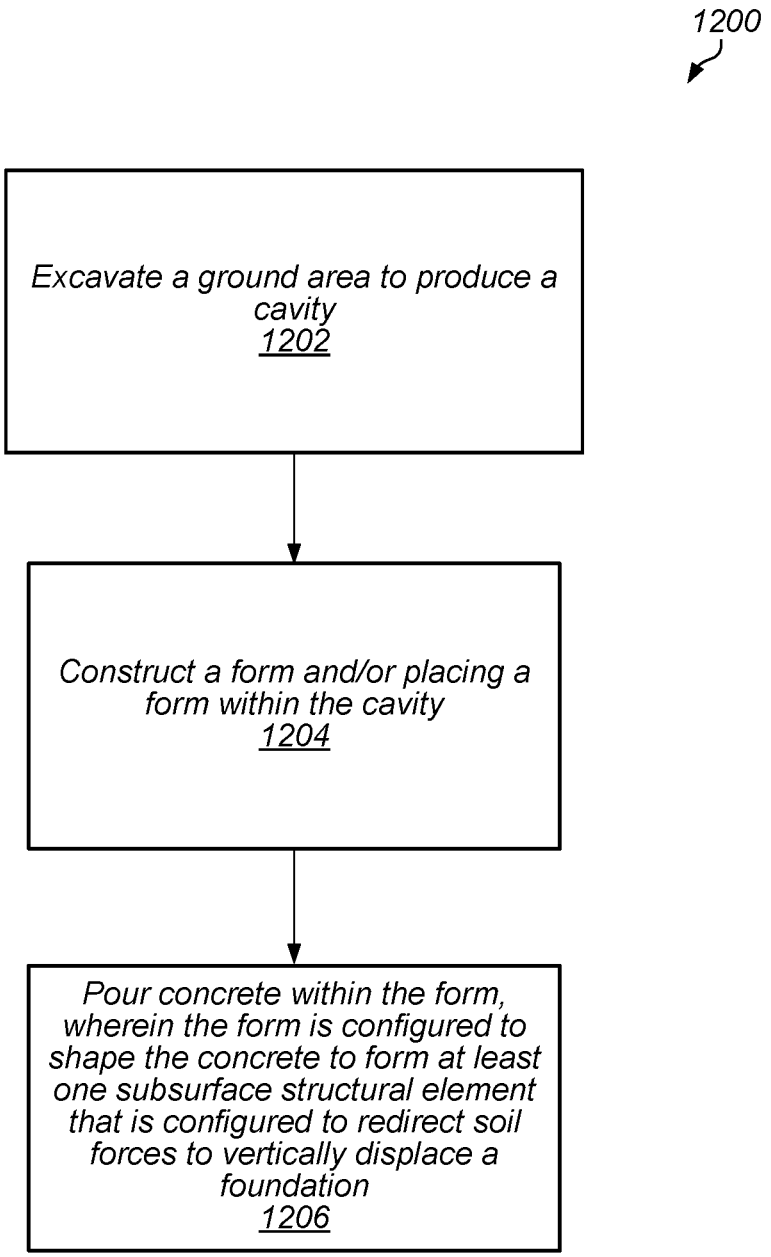
FIG. 12 is a flowchart of an example method of constructing a foundation that includes a subsurface structural element, in accordance with some embodiments.

FIG. 12 is a flowchart of an example method 1200 of constructing a foundation that includes a subsurface structural element, in accordance with some embodiments. For instance, the method 1200 may be used to construct subsurface structural elements in accordance with one or more embodiments described above with reference to FIGS. 1-11. At 1202, the method 1200 may include excavating a ground area to produce a cavity. At 1204, the method 1200 may include constructing a form and/or placing a form within the cavity. In some embodiments, constructing the form may include forming a lining layer by placing one or more linings within the cavity such that the linings are adjacent to the subsurface soil. Additionally, or alternatively, constructing the form may include filling a portion of the cavity with a filling material to form a filling layer. At 1206, the method 1200 may include pouring concrete within the form. The form may shape the concrete to the desired shape of the subsurface structural element.

Figure 13:
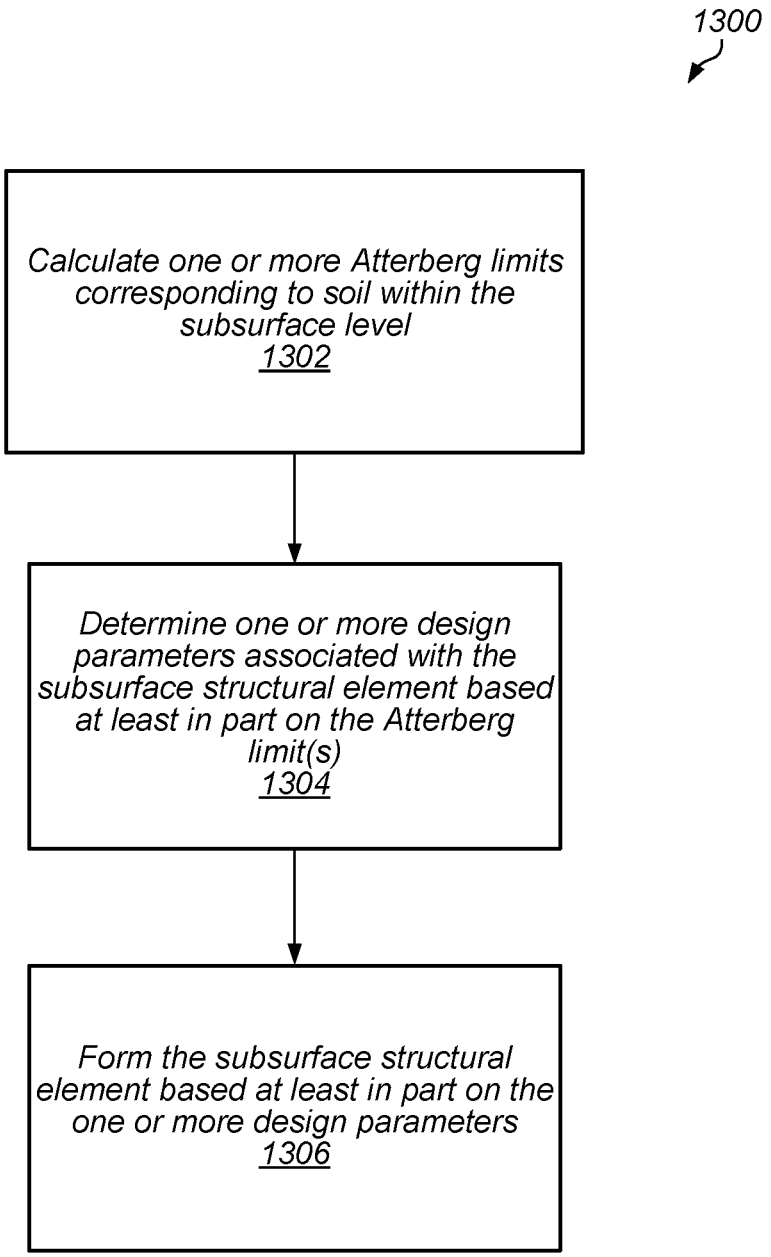
FIG. 13 is a flowchart of an example method of forming a subsurface structural element, in accordance with some embodiments.

FIG. 13 is a flowchart of an example method 1300 of forming a subsurface structural element, in accordance with some embodiments. At 1302, the method 1300 may include calculating one or more Atterberg limits (and/or a measure of water content of soils) corresponding to soil within the subsurface level. The Atterberg limits are a measure of water contents of soils. Dry, clayey soil changes in behavior and consistency as it takes on increasing amounts of water. Depending on the soil's water content, the soil may appear in a solid state, a semi-solid state, a plastic state, or a liquid state. The consistency and behavior of the soil is different in each of these states. The Atterberg limits can be used to distinguish between different types of soils (e.g., between silt and clay, between different types of silts, between different types of clays, etc.).

At 1304, the method 1300 may include determining one or more design variables associated with the subsurface structural element. In various embodiments, the design variables may include one or more of the design variables discussed above with reference to FIG. 2. At 1306, the method 1300 may include forming the subsurface structural element based at least in part on the determined design variables.

In some examples, the design variables may be determined based at least in part on the calculated Atterberg limits. The Atterberg limits may include a shrinkage limit, a plastic limit, and/or a liquid limit.

The shrinkage limit (SL) may be the water content of a soil at which further loss of moisture will not result in any more volume reduction. In some embodiments, the shrinkage limit may be calculated using ASTM International D4943.

The plastic limit (PL) may be calculated using ASTM Standard D4318, which includes rolling out a thread of a fine portion of a soil on a flat, non-porous surface. The thread will retain its shape down to a narrow diameter if the moisture content of the soil is at a level where the soil behavior is plastic. The plastic limit may be the moisture content at which the thread breaks apart at a diameter of 3.2 mm. If the thread cannot be rolled out to a diameter of 3.2 mm, then the soil may be considered non-plastic.

The liquid limit (LL) may be the water content of a soil at which the behavior of a soil (e.g., a clayey soil) changes from plastic to liquid. In some embodiments, the liquid limit may be calculated using the ASTM standard test method D4318, the Casagrande test, and/or the fall cone test (also called the cone penetrometer test).

The calculated values of the Atterberg limits may have a close relationship between properties of a soil, e.g., compressibility, permeability, and strength. Accordingly, the Atterberg limits may provide an indication of the subsurface soil forces that a subsurface structural element may incur.

Other engineering properties of a soil may also be strongly correlated with indices that may be derived using the Atterberg limits. For instance, the indices may include a plasticity index (PI), a liquidity index (LI), and/or a consistency index (CI).

The plasticity index may be a measure of the plasticity of a soil. The plasticity index may calculated as the difference between the liquid limit and the plastic limit: $PI=LL-PL$. Low plasticity index soils tend to be silt, while high plasticity index soils tend to be clay. Soils with a plasticity index of zero (non-plastic) tend to have little or no silt or clay.

The liquidity index may be a used for scaling the natural water content of a soil sample to the limits. For instance, the liquidity index may be calculated as a ratio between (1) the difference between natural water content and plastic limit and (2) the difference between liquid limit and plastic limit: $LI=(W-PL)/(LL-PL)$, where W is the natural water content.

The consistency index may indicate the firmness (or consistency) of a soil. For instance, the consistency index may be calculated as a ratio between (1) the difference between liquid limit and natural water content and (2) the difference between liquid limit and plastic limit: CI=(LL−W)/(LL−PL), where W is the natural water content.

Furthermore, the activity (A) of a soil may be the plasticity index divided by the percent of clay-sized particles (e.g., particles that are less than 2 micrometers in size) present. The dominant clay type that is present in a soil may be determined based on the activity of the soil. With a high activity soil, the soil may experience a large volume change when wetted and large shrinkage when dried.

In some embodiments, the design variables may be determined based at least in part on the plasticity index, the liquidity index, the consistency index, and/or the activity of a soil.

The order of the blocks of the methods may be changed, and various elements may be added, reordered, combined, omitted, modified, etc. Various modifications and changes may be made as would be obvious to a person skilled in the art having the benefit of this disclosure. The various embodiments described herein are meant to be illustrative and not limiting. Many variations, modifications, additions, and improvements are possible. Accordingly, plural instances may be provided for components described herein as a single instance. Boundaries between various components and operations are somewhat arbitrary, and particular operations are illustrated in the context of specific illustrative configurations. Other allocations of functionality are envisioned and may fall within the scope of claims that follow. Finally, structures and functionality presented as discrete components in the example configurations may be implemented as a combined structure or component. These and other variations, modifications, additions, and improvements may fall within the scope of embodiments as defined in the claims that follow.

What is claimed is:

1. A method, comprising:

excavating a ground area to produce cavities below an area for a surface-level horizontal base of a foundation, the cavities for forming a pattern of subsurface structural elements of the foundation, the pattern comprising two or more of the subsurface structural elements intersecting two or more other ones of the subsurface structural elements; and constructing, within the cavities, forms for forming the intersecting subsurface structural elements, wherein constructing the forms comprises forming one or more interior surfaces of the forms to shape foundation material to form the intersecting subsurface structural elements such that the forms are shaped to cause respective ones of the intersecting subsurface structural elements to narrow along at least some portion of a downward extension of the respective subsurface structural element from the horizontal base in a vertical direction orthogonal to the horizontal direction of the base.

2. The method of claim 1, wherein:

said constructing forms for forming the intersecting subsurface structural elements comprises forming a termination portion of the forms to shape the foundation material to form a respective termination portion of each of the intersecting subsurface structural elements, such that:

the corresponding termination portion of respective intersecting subsurface structural element comprises a lowermost extent of the respective intersecting subsurface structural element, and each of the intersecting subsurface structural elements do not converge to a point at the lowermost extent of the respective intersecting subsurface structural element.

3. The method of claim 1, wherein said forming one or more interior surfaces to shape foundation material to form the intersecting subsurface structural elements comprises forming one or more interior surfaces to shape foundation material to form the corresponding top portions of each of the intersecting subsurface structural elements such that the corresponding top portions meet the surface-level horizontal base at a non-zero angle that is less than 90 degrees.

4. The method of claim 1, further comprising:

lining one or more of the forms with a lining adjacent to subsurface soil; and filling the lining with filling material to create a filling material-filled gap between the lining and the intersecting subsurface structural elements;

wherein the one or more interior surfaces comprises at least a portion of the filling material.

5. The method of claim 4, wherein lining one or more of the forms with a lining comprises lining the forms with:

a first lining adjacent to the subsurface soil;

a second lining; and at least one of:

a third lining between the first lining and the second lining, wherein the third lining is configured to reduce friction between the first lining and the second lining; or a friction reducing agent between the first lining and the second lining.

6. The method of claim 1, wherein said constructing forms for forming the intersecting subsurface structural elements comprises constructing one or more permanent forms for forming the intersecting subsurface structural elements.

7. The method of claim 1, wherein said constructing, within the cavities, forms for forming the intersecting subsurface structural elements comprises forming one or more bottom portions of the forms to shape the foundation material to form one or more lowermost extents of the intersecting subsurface structural elements, wherein a respective horizontal surface of the respective lowermost extents, facing away from the horizontal base is a curved surface.

8. The method of claim 1, wherein said constructing, within the cavities, forms for forming the intersecting subsurface structural elements comprises forming one or more bottom portions of the respective intersecting structural elements to shape the foundation material to form respective lowermost extents of the intersecting subsurface structural elements, wherein a horizontal surface of the respective lowermost extents, facing away from the horizontal base is a planar surface.

9. The method of claim 1, wherein said constructing, within the cavities, forms for forming the intersecting subsurface structural elements comprises forming the forms such that the intersecting subsurface structural elements are symmetrical about a vertically oriented plane.

10. A foundation, comprising:

a surface-level horizontal base, extending in a horizontal direction, and a plurality of subsurface structural elements extending below the surface-level horizontal base, to a subsurface level, in a pattern comprising two or more of the subsurface structural elements intersecting two or more other ones of the subsurface structural elements;

wherein the intersecting subsurface structural elements narrow along at least some portion of a downward extension of the subsurface structural elements from the horizontal base in a vertical direction orthogonal to the horizontal direction of the base.

11. The foundation of claim 10, wherein:

the subsurface structural elements comprise beams;

the intersecting subsurface structural elements each terminate at a lowermost extent; and the lowermost extent of each one of the intersecting subsurface structural elements does not converge to a point.

12. The foundation of claim 10, wherein the intersecting subsurface structural elements each comprise a respective exterior surface, extending downward from the horizontal base, that meets the base at a non-zero angle that is less than 90 degrees.

13. The foundation of claim 10, further comprising:

a lining, adjacent to subsurface soil shaped as subsurface soil forms for forming the intersecting subsurface structural elements, to line the subsurface soil forms;

wherein the lining is configured to be filled with filling material to create a filling material-filled gap between the lining and the intersecting subsurface structural elements.

14. The foundation of claim 13, wherein one or more surfaces of the subsurface structural elements is formed by the filling material.

15. The foundation of claim 10, further comprising:

a first lining adjacent to subsurface soil shaped as subsurface soil forms for forming the intersecting subsurface structural elements;

a second lining; and at least one of:

a third lining between the first lining and the second lining, wherein the third lining is configured to reduce friction between the first lining and the second lining; or a friction reducing agent between the first lining and the second lining.

16. The foundation of claim 10, further comprising one or more permanent forms for forming at least a portion of the subsurface structural elements.

17. The foundation of claim 10, wherein a horizontal surface, facing away from the horizontal base, of a bottom portion of individual ones of the intersecting subsurface structural elements is a curved surface, or a planar surface.

18. The foundation of claim 10, wherein:

at least a portion of the horizontal base extends along a horizontally-oriented plane; and each of the intersecting subsurface structural elements are symmetrical about a vertically oriented plane.

19. The foundation of claim 10, wherein one or more individual ones of the intersecting subsurface structural elements comprise:

a first planar surface, comprising:

a first top portion that meets the horizontal base at a first non-zero angle that is less than 90 degrees; and a first bottom portion opposite the first top portion; and a second planar surface, comprising:

a second top portion that meets the base at the first non-zero angle or a second non-zero angle that is less than 90 degrees; and a second bottom portion opposite the second top portion; and a curved surface that extends from the first bottom portion to the second bottom portion.

20. The foundation of claim 10, one or more individual ones of the intersecting subsurface structural elements comprise:

a first planar surface, comprising:

a first top portion that meets the base at a first non-zero angle that is less than 90 degrees; and a first bottom portion opposite the first top portion;

a second planar surface, comprising:

a second top portion that meets the base at the first non-zero angle or a second non-zero angle that is less than 90 degrees; and a second bottom portion opposite the second top portion; and a third planar surface that extends from the first bottom portion to the second bottom portion.

* * * * *